US006491515B1

(12) United States Patent
Tubby et al.

(10) Patent No.: US 6,491,515 B1
(45) **Date of Patent: *Dec. 10, 2002**

(54) MULTI-MODE LIGHTER

(75) Inventors: Brian Tubby, Milford, CT (US); Paul Adams, Monroe, CT (US); Floyd Fairbanks, Naugatuck, CT (US)

(73) Assignee: BIC Corporation, Milford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/704,689

(22) Filed: Nov. 3, 2000

(51) Int. Cl.[7] ..... F23D 11/36; F23D 14/46; F23Q 7/12

(52) U.S. Cl. ..... 431/153; 431/255; 431/344; 431/345

(58) Field of Search ..... 431/255, 153, 431/344, 277, 343

(56) References Cited

U.S. PATENT DOCUMENTS

| | | | | |
|---|---|---|---|---|
| 2,498,377 A | * | 8/1950 | Nissen | 431/153 |
| 3,540,823 A | * | 11/1970 | Yasuhisa Ebine et al. | 310/339 |
| 3,758,820 A | | 9/1973 | Lohberg | |
| 4,259,059 A | | 3/1981 | Roosa et al. | |
| 4,462,791 A | | 7/1984 | Hayden | |
| 4,921,420 A | * | 5/1990 | Johnston | 431/153 |
| 5,145,358 A | | 9/1992 | Shike et al. | |
| 5,262,697 A | | 11/1993 | Meury | |
| 5,334,011 A | | 8/1994 | Frigiére | |
| 5,496,169 A | | 3/1996 | Chen | |
| 5,520,197 A | | 5/1996 | McDonough et al. | |
| 5,531,591 A | | 7/1996 | Yamazaki | |
| 5,645,414 A | | 7/1997 | Wang | |
| 5,697,775 A | | 12/1997 | Saito et al. | |
| 5,854,530 A | | 12/1998 | LaForest et al. | |
| 5,897,308 A | | 4/1999 | Saito et al. | |
| 5,934,895 A | | 8/1999 | McDonough et al. | |
| 5,971,751 A | * | 10/1999 | Lee | 431/153 |
| 6,022,212 A | | 2/2000 | Saito et al. | |
| 6,042,367 A | | 3/2000 | Saito et al. | |
| 6,077,071 A | | 6/2000 | Yeh | |
| 6,086,360 A | | 7/2000 | McDonough et al. | |
| 6,093,017 A | | 7/2000 | Saito et al. | |
| 6,213,759 B1 | * | 5/2001 | Sung | 431/153 |
| 6,224,368 B1 | | 5/2001 | Chung | 431/153 |
| 6,267,582 B1 | | 7/2001 | Lin | 431/153 |

OTHER PUBLICATIONS

Aim Flame 2 advertising sheets © 1999, 2 photos of lighter from sheets.

* cited by examiner

*Primary Examiner*—Henry Bennett
*Assistant Examiner*—Kathryn Ferko
(74) *Attorney, Agent, or Firm*—Pennie & Edmonds LLP

(57) ABSTRACT

The present invention relates to a lighter which a user actuates by at least two different modes of operation. In the first mode, a biasing member is positioned to oppose movement of an actuating assembly so that a user releases fuel and ignites the lighter only if a high-actuation-force is applied to the actuator. In this first mode, the lighter resists operation by unintended users by requiring a user to have a predetermined level of strength to actuate the lighter. In the second mode, the biasing member is moved to a different position which does not oppose movement of the actuating assembly to the same extent as the first mode so that a user may release fuel and ignite the lighter if a low-actuation-force is applied to the actuator. Moving the biasing element from the first position to the second position preferably requires the user to have a predetermined level of cognitive abilities and/or physical characteristics in order to resist use by unintended users.

52 Claims, 12 Drawing Sheets

MULTI-MODE LIGHTER

TECHNICAL FIELD

The present invention generally relates to lighters such as pocket lighters used to light cigarettes and cigars or utility lighters used to ignite candles, barbecue grills, fireplaces and campfires, and more particularly to such lighters which resist inadvertent operation or undesirable operation by unintended users.

BACKGROUND OF THE INVENTION

Lighters used for igniting tobacco products, such as cigars, cigarettes, and pipes, have developed over a number of years. Typically, these lighters use either a rotary friction element or a piezoelectric element to generate a spark near a nozzle which emits fuel from a fuel container. Piezoelectric mechanisms have gained universal acceptance because they are simple to use. U.S. Pat. No. 5,262,697 ("the '697 patent") to Meury discloses one such piezoelectric mechanism, the disclosure the '697 patent is incorporated by reference herein in its entirety.

Lighters have also evolved from small cigarette or pocket lighters to several forms of extended or utility lighters. These utility lighters are more useful for general purposes, such as lighting candles, barbecue grills, fireplaces and campfires. Earlier attempts at such designs relied simply on extended actuating handles to house a typical pocket lighter at the end. U.S. Pat. Nos. 4,259,059 and 4,462,791 contain examples of this concept.

Many pocket and utility lighters have had some mechanism for resisting undesired operation of the lighter by young children. Often, these mechanisms are on/off switches which may shut off the fuel source or may prevent movement of an actuator, such as a push-button, on the lighter. On/off switches which a user positively moves between "on" and "off" positions can be problematic. For example, an adult user may forget to move the switch back to the "off" position after use and thereby render the feature ineffective.

Other pocket and utility lighters include a spring-biased blocking latch which arrests or prevents movement of the actuator or push-button. U.S. Pat. Nos. 5,697,775 to Saito and 5,145,358 to Shike et al. disclose examples of such lighters.

There remains a need for lighters which resist inadvertent operation or undesirable operation by unintended users, but which provide each intended user with a consumer-friendly method of operating the lighters so that the lighters appeal to a variety of intended users.

SUMMARY OF THE INVENTION

The present invention is directed to a lighter with at least two modes of operation. In either mode of operation, the lighter preferably is operational with no blocking mechanism(s) which arrests or prevents movement of an actuating member.

The present invention in one embodiment relates to a lighter which generally comprises a housing which contains fuel, an actuating member for actuating the lighter, and a movable biasing member. The biasing member preferably moves between a high-actuation-force position and a low-actuation-force position. More specifically, in the high-actuation-force position, the biasing member provides a first opposing force which opposes actuation of the lighter and preferably, when the user moves or repositions the biasing member to the low-actuation-force position, the biasing member provides a second different opposing force which opposes actuation of the lighter.

Preferably the first opposing force provided by the movable biasing member is greater, and optionally significantly greater, than the second opposing force. Optionally, the second opposing force may be substantially zero. The biasing member in the low-actuation-force mode may not oppose movement of the actuating member when the user applies a force thereto to the same extent as in the high-actuation-force mode. In one embodiment, the biasing member in the high-actuation-force position may be operatively associated with, engaged or in contact with, or coupled to the actuating member, and in the low-actuation-force position, the biasing member may be in contact with or disengaged from the actuating member.

In accordance with one embodiment, the actuating member may selectively dispense fuel, activate the ignitor assembly or perform both functions. The lighter optionally may have an ignitor assembly actuated by the actuating member. The ignitor assembly may include a piezoelectric unit. The actuating member may be at least one trigger. In the high-actuation-force position the movable biasing member may resist movement of the trigger to an actuation position by increasing the force necessary to actuate the trigger.

In yet another embodiment, the actuating member may be part of an actuating assembly that includes the trigger, a linking rod, and a pivoting member. The linking rod may be operatively connected to the ignitor assembly, and selectively activates the ignitor assembly. In such an embodiment, the actuating member can be the trigger or the linking rod. The pivoting member may be connected to the housing, disposed between the trigger and the linking rod, and selectively dispense fuel to the nozzle. In the high-actuation-force position the biasing member may contact the linking rod and apply the first opposing force to the linking rod to oppose movement of the linking rod. In the low-actuation-force position, the biasing member may be moved or repositioned and applies a second opposing force which preferably is less than the first opposing force, and optionally may be substantially less than the first opposing force or substantially zero.

In a further aspect, a latch member may be operatively associated with the biasing member. The latch member can be coupled to the housing in a number of ways, such as pivotally, slidably or in a cantilevered fashion. In the cantilevered coupling, one end of the latch member is fixed to the housing while the other end is free to move. Movement of the latch member may move the biasing member between the high-actuation-force position and the low-actuation-force position. The latch member may be separate from or integral with the biasing member, or the biasing member may be moved or repositioned directly by the user.

In an alternate embodiment, the lighter further includes a biasing member with an engaging portion and an actuating assembly with an engaging portion. The biasing member is movable between a first, at rest state and a second state. In the first state, the biasing member engaging portion is associated with the engaging portion of the actuating assembly. In the second state, the engaging portion of the actuating assembly moves the engaging portion of the biasing member. Less than about 10 kg applied to the trigger changes the biasing member from the first state to the second state and activates the ignitor.

This embodiment may further include a valve for dispensing fuel which is biased into a closed position and moveable to an open position. The actuating assembly selectively moves the valve. When in the high-actuation-force position, the biasing member resists or opposes movement of the actuating assembly. If the user applies a force equal to or greater than a first trigger force to the actuating assembly when the biasing member is in the high-actuation-force position, the valve moves from the closed position to the open position. When the biasing member is in the low-actuation-force position, the user may apply a lower second trigger force to the actuating assembly in order to move the valve between such positions.

One preferred aspect of the multi-mode lighter according to at least one embodiment is that after multiple actuations of the lighter, the first and second trigger forces required to operate the lighter in either mode, and more preferably the first trigger force, remains substantially constant. Thus, the first and second opposing forces exerted by the movable biasing member preferably do not substantially decrease with use of the lighter.

According to yet another embodiment of the present invention, the movable biasing member is configured and adapted in the high-actuation-force position to resist movement of the actuating assembly to an operative position and has a predetermined, at rest, length which upon movement of the actuating assembly may change between a first length and a second length. In one embodiment, the biasing member is configured such that its length in a first position is less than its length in a second position such as in, for example, a tension or extendable spring. In another embodiment, the biasing member is configured such that its length in its first position is greater than the length in its second position, as in, for example, a compression spring.

According to yet another embodiment, the lighter comprises a housing having a supply of fuel, an ignitor assembly for igniting the dispensed fuel, an actuating member associated with the housing, and a repositionable biasing member disposed to the housing. A predetermined actuating force is necessary to move the actuating member to an actuation position to actuate the lighter. In a first position, the biasing member is associated with the actuating member such that a first actuating force greater than said predetermined actuating force is required to move the actuating member to the actuation position.

According to a preferred aspect of the multi-mode lighter, the first or high-actuation-force mode preferably relies more on the user's physical characteristics, and more specifically strength characteristics, while the second or low-actuation-force mode preferably relies more on the user's cognitive abilities and dexterity. In yet another preferred, but optional, aspect of this lighter, the user may actuate the lighter in the high-actuation-force mode with a single finger. Moreover, according to another preferred, but optional, aspect of this lighter, the user may actuate the lighter in the low-actuation-force mode with two fingers. One further preferred, but optional, feature of the lighter is that actuation of the lighter in the high-actuation-force mode may occur by a different actuation sequence or movement than the actuation sequence or movements which may occur in the low-actuation-force mode.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE PREFERRED EMBODIMENTS

Figure 1:
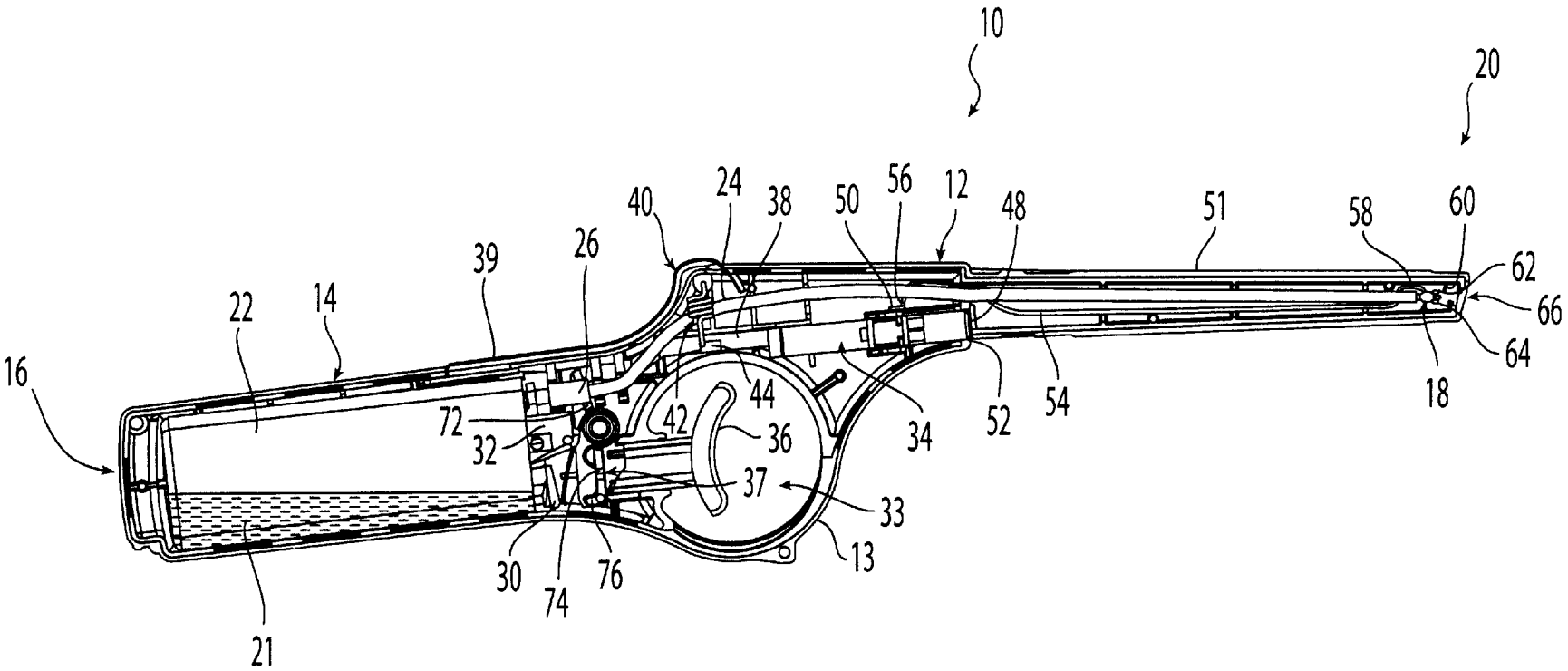
FIG. 1 is a cut-away, side view of a utility lighter of one embodiment of this invention showing various inner components thereof.

Turning to FIG. 1, an embodiment of a utility lighter 10 constructed in accordance with the present invention is shown with the understanding which those of ordinary skill in the art will recognize many modifications and substitutions which may be made to various elements. While the invention will be described with reference to a utility lighter, one of ordinary skill in the art could readily adapt the teaching to conventional pocket lighters and the like.

Lighter 10 generally includes a housing 12 which may be formed primarily of molded-rigid-polymer or plastic materials such as acrylonitrile butadiene styrene terpolymer or the like. Housing 12 includes a trigger guard 13 and a handle 14, which forms a first end 16 of the lighter. An optional nozzle 18 is disposed at a second end 20 of the housing 12. The nozzle 18 emits fuel 21 to feed a flame as will be described herein. Nozzle 18 may include a diffuser, such as a spring.

Figure 2:
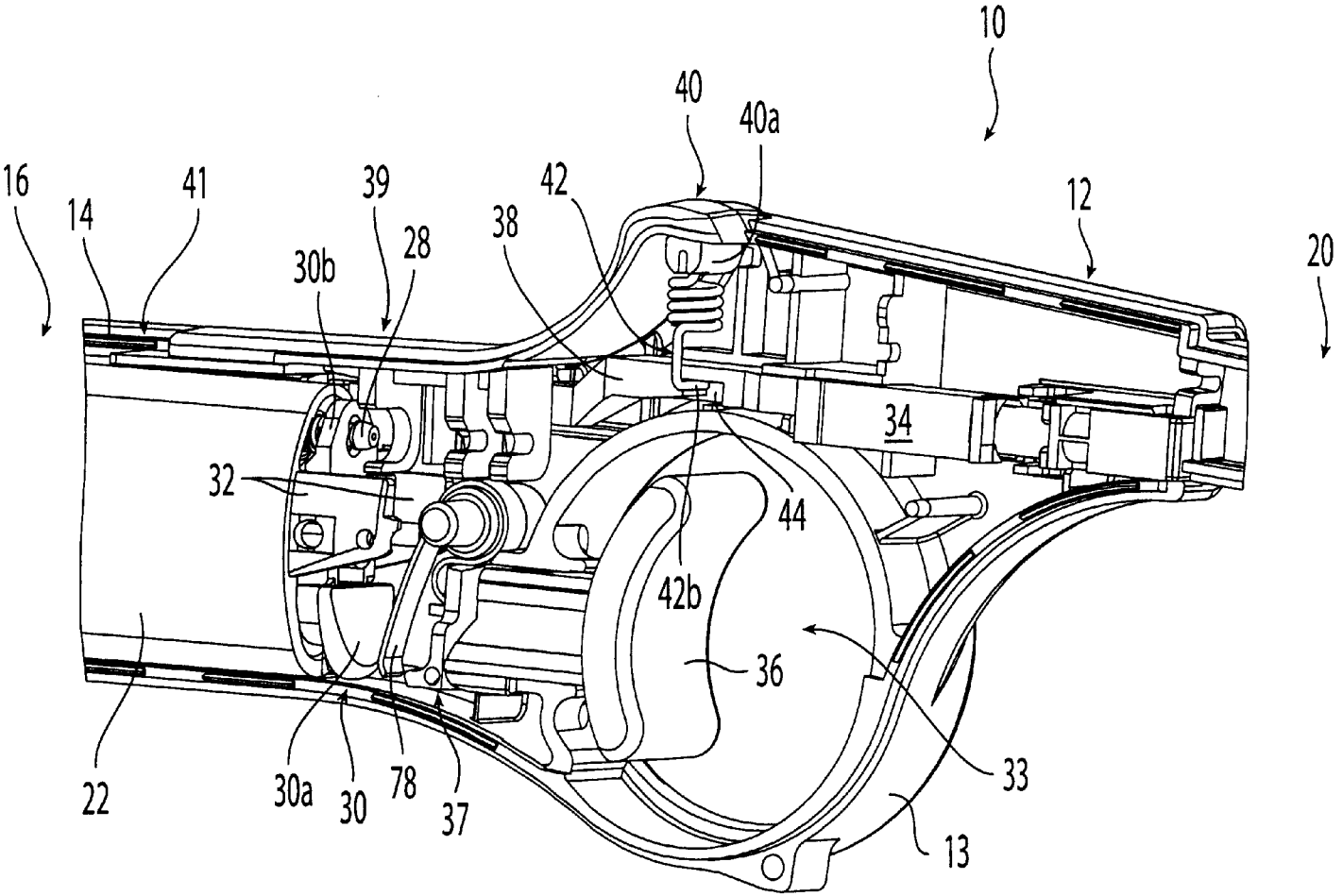
FIG. 2 is an enlarged, partial, perspective view of the lighter shown in FIG. 1 with various components removed for clarity and better illustrating various inner details such as a latch member and a biasing member, wherein the lighter is in an initial state and the biasing member is in a high-actuation-force position.

Handle 14 preferably contains a fuel supply container 22, which may hold butane or a propane and butane mixture, or the like. A suitable fuel supply container 22 is disclosed in U.S. Pat. No. 5,934,895 ("the '895 patent"), the disclosure of which is incorporated herein by reference in its entirety. A conduit 24, such as a plastic tube, is fixed to a fluid connector 26 which is positioned next to or connected to a jet and valve assembly 28 (as shown in FIG. 2) on fuel supply container 22. The opposite end of conduit 24 connects with nozzle 18.

Referring to FIGS. 1 and 2, jet and valve assembly 28 is operated by a valve actuator 30 which includes first and second sides 30*a* and 30*b*. The valve actuator 30 is pivotally attached to ears 32 via holes defined therein. The ears 32 are connected to the fuel supply container 22. Thus, when valve actuator 30 is depressed, e.g., the first side 30*a* is moved toward end 16, and the valve actuator 30 pivots about ears 32 which moves the second side 30*b* towards the second end 20 of the lighter. This movement releases fuel by jet and valve assembly 28 which flows through fluid connector 26, conduit 24, and finally to nozzle 18.

Referring to FIG. 1, a compression spring (not shown) is preferably disposed under side 30*a* of valve actuator 30 to exert a force on valve actuator 30 which biases the jet and valve assembly 28 into a closed position. Such a compressive spring is disclosed in U.S. Pat. No. 5,520,197 ("the '197 patent"), the disclosure of which is incorporated by reference in its entirety. A preassembled fuel supply unit may include fuel supply container 22, biased valve actuator 30, and jet and valve assembly 28.

Figure 5:
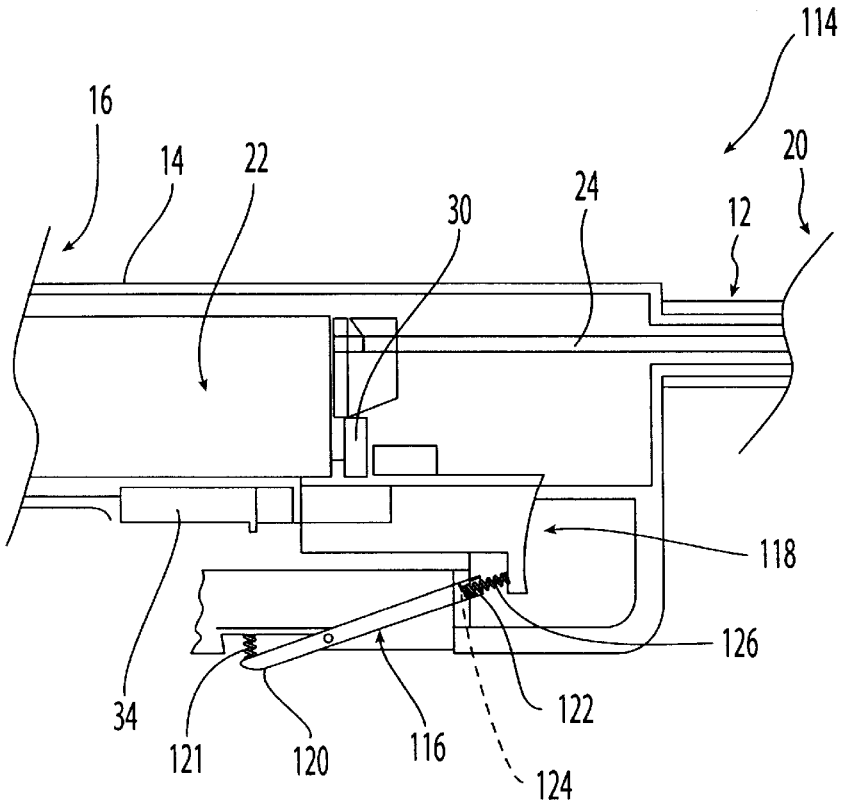
FIG. 5 is an enlarged, partial, side, schematic view showing a fourth embodiment of the lighter of the present invention wherein the lighter is in the initial state and the biasing member is in the high-actuation-force position.
Figure 5A:
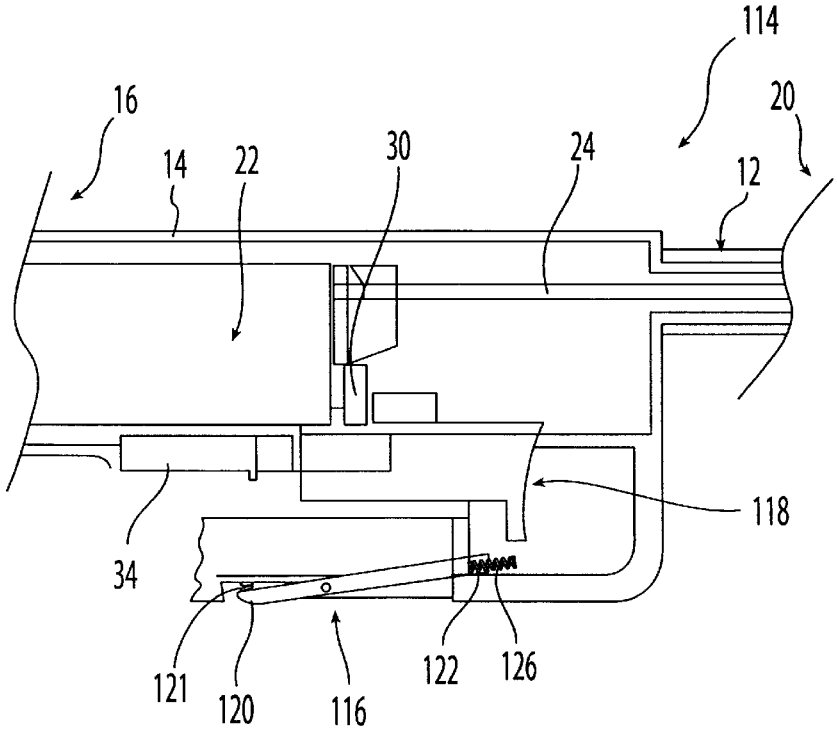
FIG. 5A is an enlarged, partial, side, schematic view showing the lighter of FIG. 5, wherein the biasing member is in the low-actuation-force position.

Referring to FIG. 2, lighter 10 also includes an actuating assembly 33 which facilitates depression of the valve actuator 30 to selectively release fuel. In this embodiment, the actuating assembly also selectively activates an ignitor assembly 34 for igniting the fuel. Alternatively, the actuating assembly may perform either the fuel release or ignition function, and another mechanism or assembly may perform the other function. Actuating assembly 33 in the illustrated embodiment comprises a trigger 36, a pivoting member 37, and a linking rod 38 operatively connected to the ignitor assembly 34, although actuating assembly 33 may comprise only a trigger as illustrated in FIGS. 5 and 5A. These components are described in detail below.

As shown in FIG. 2, latch member 39 is on the top side of the housing 12 and the trigger 36 and stationary trigger guard 13 are opposite the latch member 39 near the bottom side of the handle 14 of housing 12. The latch member 39 generally includes an unsupported, movable, front end 40 which includes a downwardly extending boss 40*a* and a rear end 41 fixed to the handle 14. The latch member is resilient and the fixed-rear end 41 connects latch member 39 to handle 14 of housing 12 in a cantilevered manner. Hence, unsupported front end 40 of latch member 39 may move downwardly. One of ordinary skill in the art can readily appreciate that latch member 39 also may be coupled to the housing in another manner such as pivotally, slidably or rotatably coupled to the housing.

Although not necessary for all aspects of this invention, an electric ignitor assembly such as a piezoelectric mechanism is the preferred ignitor assembly 34. The ignitor assembly may alternatively include other electronic ignition components, such as the ones shown in U.S. Pat. No. 3,758,820 and U.S. Pat. No. 5,496,169, a spark wheel and flint assembly or other well-known mechanisms in the art for generating a spark or igniting fuel. The piezoelectric mechanism may be the type disclosed in the '697 patent. Piezoelectric mechanism 34 has been illustrated in FIGS. 1 and 2 schematically and particularly described in the '697 patent.

In general, piezoelectric mechanism 34, as shown in FIG. 1, is a telescopic assembly which includes a piezoelectric crystal in electrical contact with and generally situated between electrical contacts 48, 50. When the piezoelectric mechanism 34 is compressed, it generates a voltage between electrical contacts 48, 50. Electrical contact or anvil 48 directly contacts an electrically conductive shell 51 at junction location 52. The shell 51 is disposed on the outside of a portion of housing 12 and is preferably made out of metal.

Electrical contact 50 contacts an impact pad positioned on an opposite side of the piezoelectric crystal. Electrical contact 50 also contacts an insulated wire 54 having two exposed ends 56, 58. Exposed end 56 is connected to contact 50 while exposed end 58 electrically connects with nozzle 18. Nozzle 18 acts as an electrode and is preferably formed of an electrically conductive metal, such as brass or zinc for this purpose.

Tab 60 is formed integrally with shell 51 near proximate end 20 to create a spark gap 62 with an outlet 64 of nozzle 18. Alternatively, a separate tab may be associated with shell 51 to create the spark gap 62. When the lighter is operated, a spark is created at nozzle 18 which will ignite the released fuel. An opening 66 at the end of conductive shell 51 allows the passage of a flame from the lighter. Also, in a conventional manner, side vent apertures (not shown) may be provided to allow the intake of air.

Figure 2A:
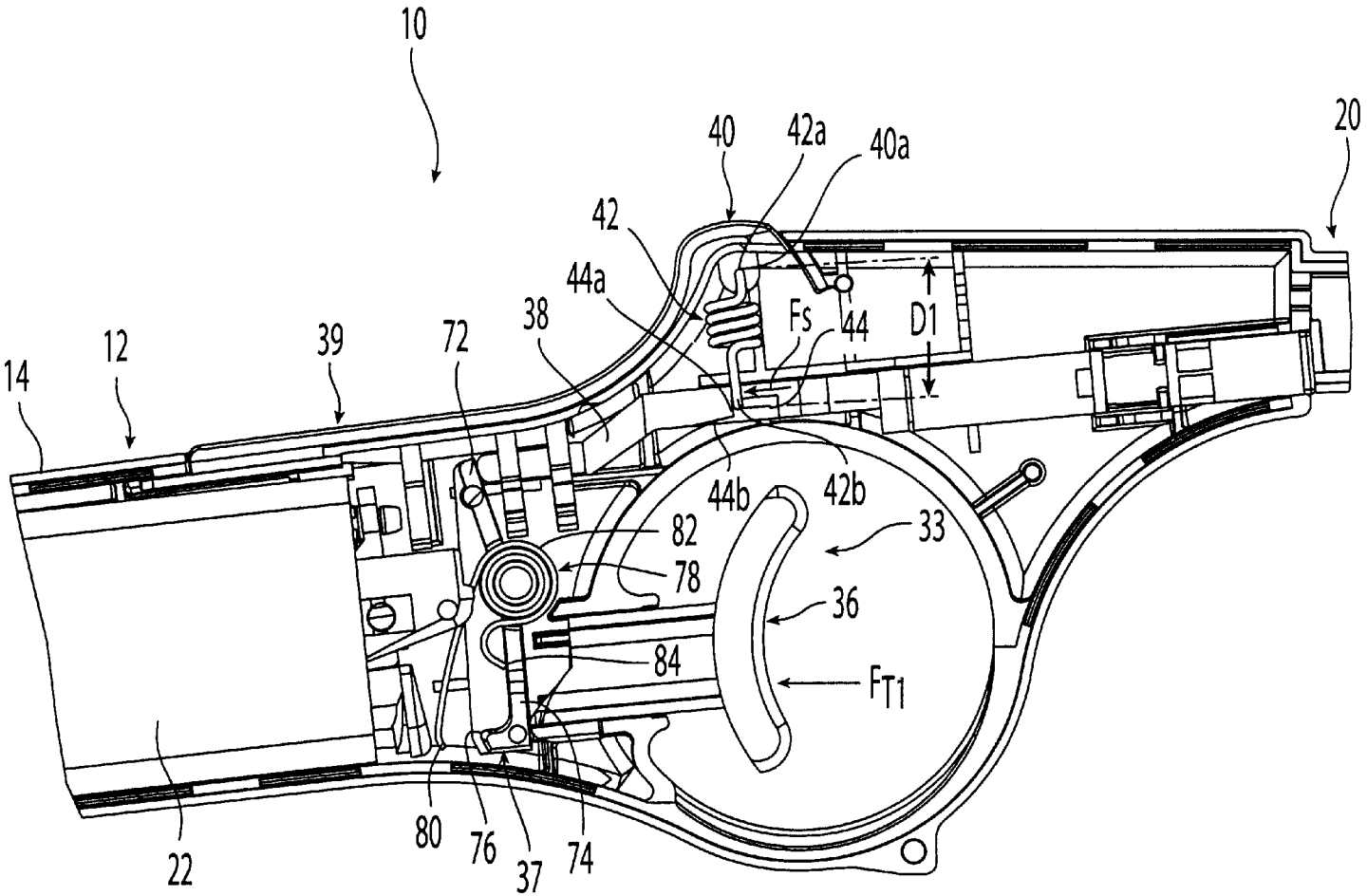
FIG. 2A is an enlarged, partial, side view of the lighter of FIG. 2.

Referring to FIGS. 2 and 2A, further details of the actuating assembly 33 which includes the trigger 36, pivoting member 37, and linking rod 38 will now be discussed. Trigger 36 is preferably slidably coupled to housing 12. The trigger 36 and housing 12 may be configured and dimensioned so that movement of the trigger forward or rearward is limited. One of ordinary skill in the art can appreciate that the trigger can alternatively be coupled or connected to the housing in another manner, such as in a pivotal, rotatable or cantilevered fashion.

Pivoting member 37 includes a pair of arms 72, 74 and is pivotally mounted to the housing 12 to operatively connect the trigger 36 and the linking rod 38. Arm 72 bears against one end of linking rod 38 while arm 74 may include a knob 76 for indirectly or directly depressing valve actuator 30 when the user pulls trigger 36.

Returning to FIG. 1, housing 12 has suitable support members for supporting linking rod 38 for sliding movement in forward and rearward directions. Further support members are provided in the lighter 10 for various purposes, such as supporting piezoelectric mechanism 34, conduit 24 and fluid connector 26.

With continued reference to FIG. 1, the actuating assembly 33 of the lighter 10 preferably also includes a linking mechanism or leaf spring 78 which operatively associates the trigger 36 with the valve actuator 30 in order to provide fuel at the nozzle outlet 64 when a spark is first created across the spark gap 62. The leaf spring 78 is preferably disposed between the trigger 36 and the valve actuator 30.

The leaf spring 78, in the embodiment of FIGS. 1 and 2*a*, has a proximate end 80 positioned near the valve actuator 30, a central portion 82 which wraps around the central portion of the pivoting member 37, and a distal end 84 which abuts arm 74 of the pivoting member 37 which prevents the leaf spring 78 from rotating on the pivoting member 37 in the loading direction. Leaf spring 78 may be manufactured from a metal having resilient properties, such as spring steel, or from other types of materials. It should be noted that while leaf spring 78 is shown mounted to pivoting member 37 it may alternatively be coupled to trigger 36, valve actuator 30, another part of housing 12 in proximity to valve actuator 30, or any combination of these parts.

Alternatively, or in addition thereto, pivoting member 37 may be biased to return to an initial position using a conventional return spring (not shown) disposed within the two telescopic members of piezoelectric mechanism 34. The piezoelectric return spring maintains the separation between the telescopic members. The return spring also moves or assists in moving linking rod 38, which is in physical contact with pivoting member 37, to its initial position. Such a return spring also is disclosed in the '697 patent.

Referring to FIGS. 1 and 2A, in operation a user depresses or pulls trigger 36 to move it toward the first end 16 of housing 12. This rotates pivoting member 37 clockwise. As pivoting member 37 rotates, the proximal end 80 of leaf spring 78 moves and depresses valve actuator 30 and releases fuel from fuel container 22 by moving jet and valve assembly 28 to the open position. If the user continues to depress the trigger 36, the user compresses and actuates piezoelectric mechanism 34 to generate a spark across spark gap 62. By activating the fuel supply prior to generation of the spark, the fuel has time to travel through the conduit 24 to reach nozzle outlet 64 prior to or simultaneous with the creation of a spark at the nozzle. When trigger 36 is released, the piezoelectric return spring biases the pivoting member 37 in the counter-clockwise direction and the jet and valve assembly 28 moves to the closed position.

Referring to FIGS. 2 and 2A, lighter 10 has two different modes of operation. Each mode is designed to resist undesired operation by unintended users in different ways. The first-operative mode or high-actuation-force mode (i.e., the high-force mode) and the second mode of operation or low-actuation-force mode (i.e., the low-force mode) are configured so that one mode or the other can be used. The high-force mode of lighter 10 provides resistance to undesirable operation of the lighter by unintended users based primarily on the physical differences, and, more particularly, the strength characteristics of unintended users versus some intended users. In this mode, a user applies a high-actuation or high-operative force to the trigger in order to operate the lighter. Optionally, the force which is necessary to operate the lighter in this mode may be greater than unintended users can apply, but within the range which some intended users can apply.

The low-force mode of lighter 10 provides resistance to undesirable operation of the lighter by unintended users based more on the cognitive abilities of intended users than the high-force mode. More specifically, the second mode provides resistance due to a combination of cognitive abilities and physical differences, more particularly the size characteristics and dexterity between intended users and unintended users.

The low-force mode may rely on the user operating two components of the lighter to change the force, from the high-actuation force to the low-actuation force, which is required to be applied to the trigger to operate the lighter. The low-force mode may rely on a user repositioning a biasing member from a high-actuation-force position (i.e., the high-force position) to a low-actuation-force position (i.e., the low-force position). The user may move the biasing member by depressing a latch member. After moving the biasing member, the user can operate the lighter by applying less force to the trigger. The low-force mode may rely on a combination of the physical and cognitive differences between intended and unintended users such as by modifying the shape, size or position of the latch in relation to the trigger, or alternatively, or in addition to, modifying the force and distance required to activate the latch and the trigger. Requiring the trigger and latch to be operated in a particular sequence also may be used to achieve the desired level of resistance to unintended operation.

Referring to FIGS. 2 and 2A, one embodiment of a lighter having a high-force mode and a low-force mode will be described. The lighter of FIGS. 2 and 2A has a movable biasing member, such as, for example, coil spring 42 operatively associated with latch member 39 and linking rod 38. One end 42*a* of the spring 42 is connected to the boss 40*a* and the other end has a leg or engaging portion 42*b* which extends perpendicularly from an adjacent section of the spring to form a L-shape therewith. In this embodiment the spring leg 42*b* is pivotally connected to the boss 40*a*, however in another embodiment the leg 42*b* can be rigidly connected to the boss 40*a*.

In an initial or rest position in the high-force mode, the spring 42, and more particularly spring leg 42*b* is disposed within a stop structure such as recess 44 defined in the linking rod 38 of the actuating assembly and has a length of D1. The recess 44 includes an engaging portion of the actuating assembly. As best seen in FIG. 2A, the recess 44 includes an engaging surface with two portions. These portions are vertical portion 44*a* and angled or inclined surface portion 44*b*. In an alternative embodiment, the linking rod can include solely the vertical portion 44*a*, solely the angled portion 44*b* or combinations of these portions. In the embodiment shown, spring 42 in the rest position may or may not apply any force to linking rod 38. The spring 42 with leg 42*b* in recess 44 contacting vertical portion 44*a* is thus in a high-force position. When a user attempts to actuate trigger 36, which would move rod 38 toward end 20, spring 42 applies a spring force $F_S$ which opposes this movement.

To actuate the lighter in this high-force mode, i.e., when the spring leg 42*b* is disposed in recess 44, a user applies at least a first trigger force $F_{T1}$ to the trigger 36 which is substantially equal to the sum of a spring force $F_S$, and all additional opposing forces $F_{OP}$. The spring force $F_S$ may comprise two forces in series, which are the force necessary to elongate the spring 42 and the force necessary to move front end 40 of the latch member 39 downward. The opposing forces $F_{OP}$ may comprise the forces applied by the various other elements and assemblies which are moved and activated in order to operate the lighter, such as the spring force from the return spring in piezoelectric unit 34, and the frictional forces caused by the movements of the valve actuator, the linking mechanism, the actuating assembly, and any other forces due to springs and biasing members which are part of or added to the actuating assembly, fuel container, or which are overcome to actuate the lighter. The particular forces $F_{OP}$ opposing operation of the lighter would depend upon the configuration and design of the lighter and thus will change from one lighter design to a different lighter design. In this mode, if the force applied to the trigger is less than a first trigger force $F_{T1}$, the lighter will not operate.

Figure 2B:
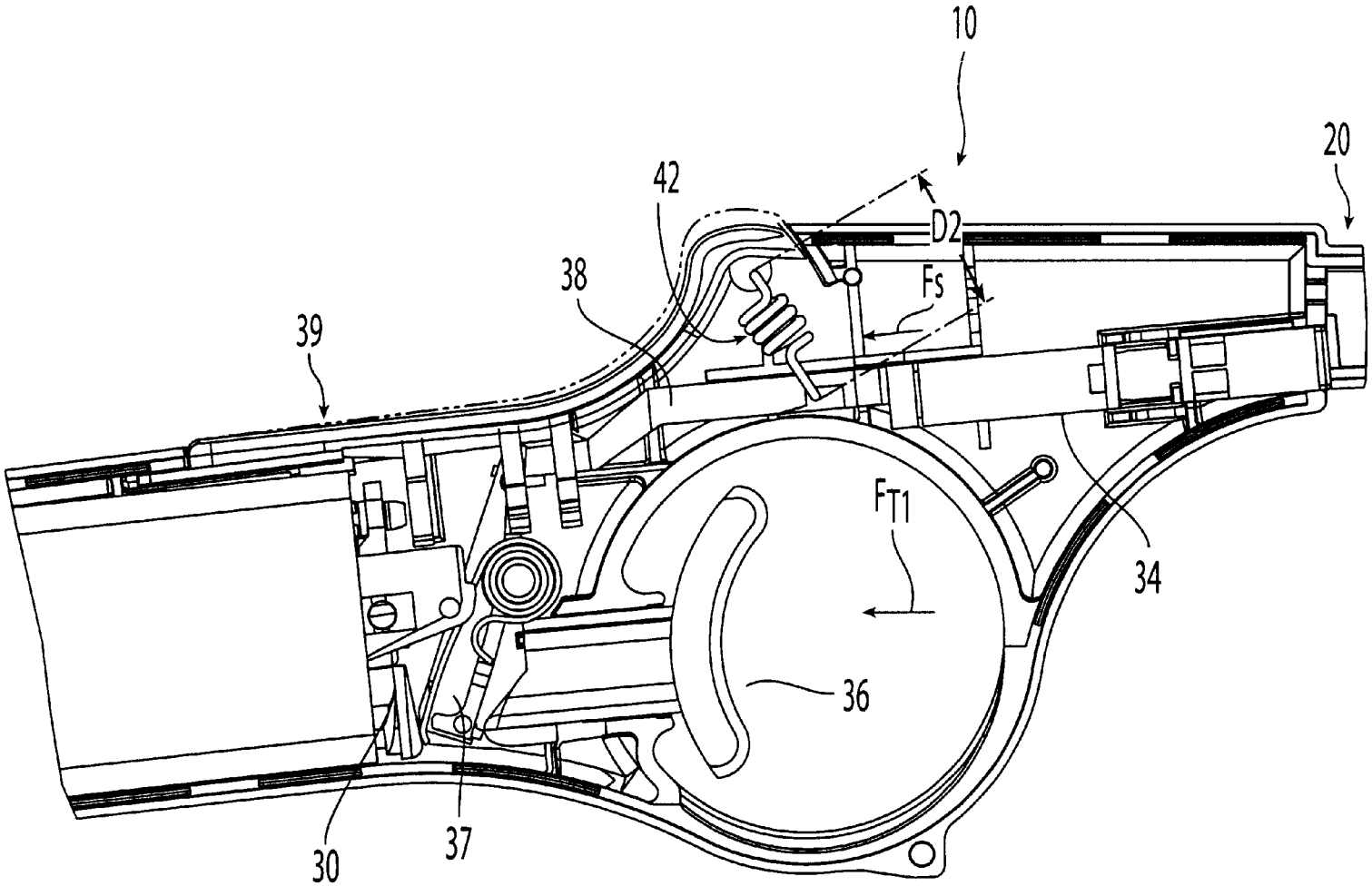
FIG. 2B is an enlarged, partial, side view of the lighter of FIG. 2A after a first actuating movement, where the biasing member is in the high-actuation-force position.

As shown in FIG. 2B, when a user applies a force to the trigger 36 at least substantially equal to or greater than the first trigger force $F_{T1}$, the trigger 36 moves the pivoting member 37, which rotates the leaf spring 78, which depresses the valve actuator 30 to release the fuel. Movement of the pivoting member 37 also moves the linking rod 38 toward end 20, elongating or stretching the spring 42 (as shown in FIG. 2B), and allowing the linking rod 38 to press and actuate the piezoelectric unit 34 and thus ignite the released fuel. In this position, the spring 42 has a length D2 greater than the length D1 (as shown in FIG. 2A). During this mode of operation, depending upon the resiliency of the latch member and its connection to the housing, the free end 40 of the latch member 39 may be pulled downward due to the force exerted by the biasing member 42 when it is stretched. The original position of the latch member 39 before such downward movement is shown by broken lines in FIG. 2B.

When the trigger 36 is released, the return spring within the piezoelectric mechanism 34 and the spring 42 move or assist in moving the linking rod 38 back into its initial, at rest, position. Pivoting member 37 is biased in a counter-clockwise direction and spring 78 disengages valve actuator 30 which is biased to close jet and valve assembly 28 and shut off the supply of fuel to nozzle 18. This extinguishes the flame emitted by the lighter. Thus, the pivoting member 37 and the trigger 36 return to their initial or at rest position. Releasing the trigger 36 also allows the latch member 39, if it was moved from the force exerted by the stretching biasing member 42, to return to its initial position. The resiliency of the latch member 39 moves it back to its initial position. In another embodiment, the resiliency of the latch member 39 may be aided by a spring to return the latch member to its initial position. As a result, upon release of the trigger, the lighter automatically returns to the initial state, where the biasing member 42 is in the high-force position (as shown in FIG. 2), which requires a high-actuation-force to actuate the trigger.

The lighter may be designed so that a user would have to possess a predetermined strength level in order to ignite the lighter in the high-actuation-force mode. The lighter optionally may be configured so that a user may actuate the lighter in the high-actuation-force mode with a single motion or a single finger.

Figure 2C:
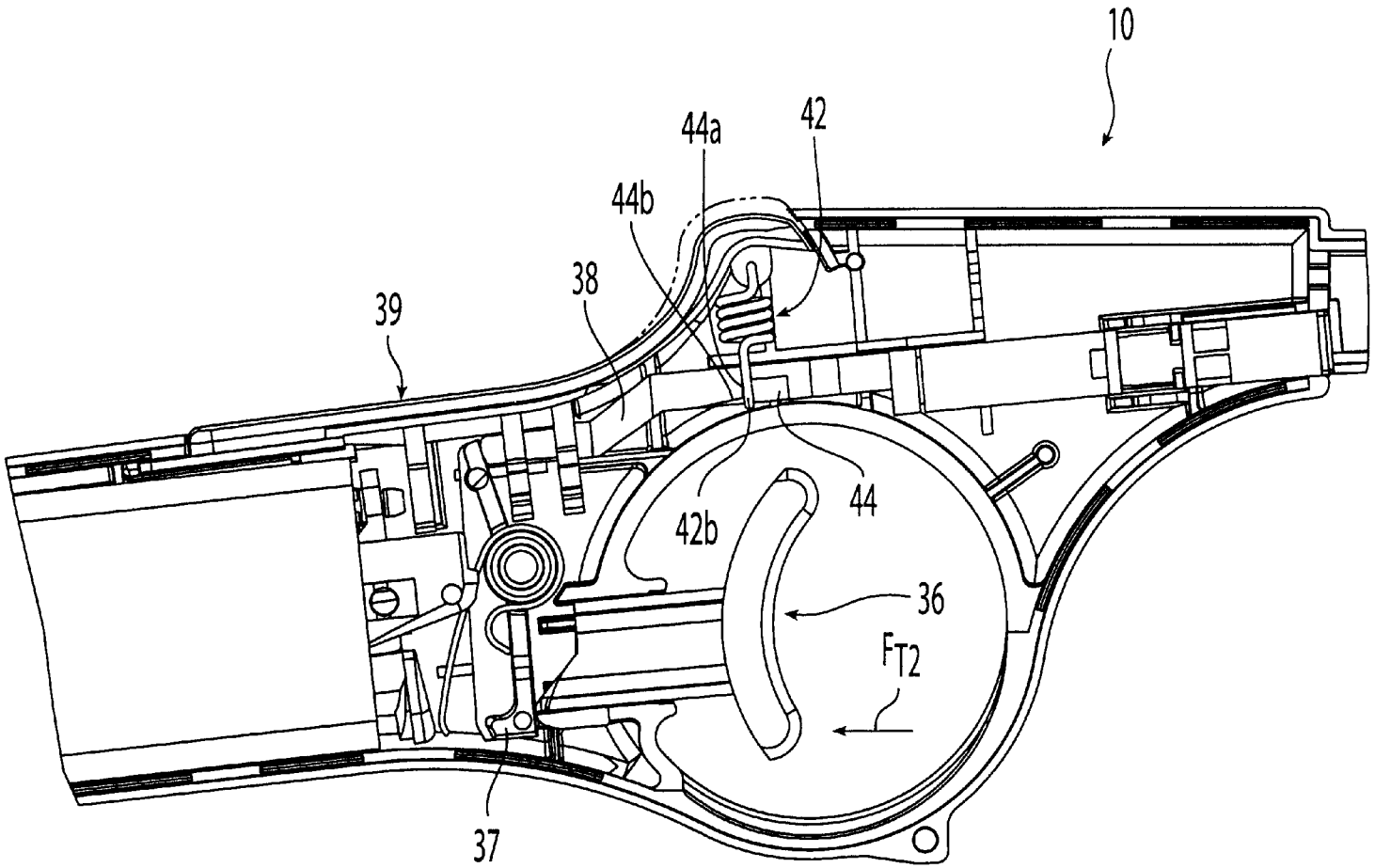
FIG. 2C is an enlarged, partial, side view of the lighter of FIG. 2A after a second actuating movement, where the biasing member is in a low-actuation-force position.

Alternatively, if the intended user does not wish to use the lighter by applying a high first trigger force F., (i.e., the high-actuation-force) to the trigger, the intended user may operate the lighter 10 in the low actuation-force mode (i.e., the low-force mode), as depicted in FIG. 2C. This mode of operation comprises multiple actuation movements, and in the embodiment shown, the user applies two motions to move two components of the lighter for actuation.

In the lighter of FIG. 2, the low-force mode includes repositioning the biasing member such that it does not oppose motion of the linking rod 38 to the same extent as in the high-force mode. In the low-force mode, a force substantially equal to or greater than second trigger force $F_{T2}$ (i.e., a low-actuation-force) is applied to the trigger 36 to actuate the lighter in conjunction with depressing the latch member. In this mode of operation, the second trigger force $F_{T2}$ is preferably less, and optionally significantly less, than the first trigger force $F_{T1}$.

As shown in FIG. 2C, the low-force mode in this embodiment includes depressing the free end 40 of the latch member 39 from the initial position (shown in phantom) toward the trigger 36 to a depressed position. Due to the operative association between the latch member 39 and the spring 42, downward movement of the latch member 39 also moves the spring 42 downward.

The latch member may be partially or fully depressed with different results. Depending on the configuration of the lighter components, if latch member is partially depressed, the leg 42*b* may be in contact with or adjacent the vertical portion 44*a*, the angled portion 44*b* or the lower surface of the linking rod 38. If the latch member 39 is depressed so that the leg 42*b* is in contact with or adjacent the vertical portion 44*a* of the linking rod 38, the leg 42*b* is still within the recess 44 and still in the high-force mode. If the latch member 39 is depressed so that the leg 42*b* is in contact with or adjacent the angled portion 44*b* of the linking rod 38, the leg 42*b* is considered to be out of the recess and the lighter is in the low-force mode. If the latch member 39 is depressed so that the leg 42*b* is in contact with the lower surface of the linking rod 38, the leg 42*b* is out of the recess and the lighter is in the low-force mode. In some configurations, the lighter can be designed so that when the latch member 39 is fully depressed, the leg 42*b* is completely out of contact with (e.g., below) the lower surface of the linking rod 38. In other configurations, full depression of the latch member can leave the leg 42*b* in contact with the angled surface 44*b* or lower surface of the linking rod.

The force applied to the trigger in order to activate the lighter in the low-force mode, i.e., second trigger force $F_{T2}$, at least has to overcome the opposing forces $F_{OP}$ as discussed above to actuate the lighter. In addition, if the leg 42*b* is contacting the angled surface 44*b* or the lower surface of the linking rod 38, the second trigger force must also overcome the friction forces generated by this contact during movement of the actuating assembly. The user, however, may not have to overcome the additional spring force $F_S$ (as shown in FIG. 2A) applied by spring 42 and latch member 39 depending on whether the user partially or fully depresses the latch member. If partially depressed, the mode of the lighter will depend on whether the leg 42*d* is contacting the vertical portion 44*a* or the angled portion 44*b*. In the case of the leg 42*d* contacting the vertical portion 44*a*, the user may still have to overcome the high spring forces due to the leg 42*d* still being within the recess 44. In the case of the leg contacting the angled portion 44*b*, the user may still have to overcome some spring forces due to stretching of the spring as the leg 42*d* travels along the angled portion 44*b*. If fully depressed, the user may not have to overcome any spring forces since the leg 42*d* may be out of recess 44. As a result, the second trigger force $F_{T2}$ required for the low-force mode is less than the first trigger force $F_{T1}$ required for the high-force mode. If the lighter is designed so that full depression of the latch member 39 moves the spring 42 out of contact with the latch member 39, the spring force $F_S$ may be substantially zero.

In the low-force mode in the lighter of FIG. 2, the latch 39 can be released after the trigger is pressed and gas will continue to flow to the nozzle and the flame will not be extinguished until the trigger is released. When the trigger 36 and latch member 39 are released, the return spring within the piezoelectric mechanism moves or assists in moving the linking rod 38 into its initial position and returns the pivoting member 37 and the trigger 36 to their initial positions. In addition, the resiliency of the latch member 39 moves it back to its initial position and leg 42*b* moves back into recess 44. Thus, the lighter automatically returns to the initial position, where the biasing member 42 is in a high-force position and the lighter requires a high-actuation force to operate.

Preferably, in order to perform the low-force mode, the user has to possess a predetermined level of dexterity and cognitive skills so that depression of the latch member 39 and movement of the trigger are carried out in the correct sequence. In the low-force mode, a user can use a thumb to press latch member 39 and a different finger to apply the trigger force. The lighter may be designed so that the trigger force preferably is applied after the latch member 39 is depressed so that a proper sequence is carried out to operate the lighter. Alternatively, another sequence can be used for actuation, and the present invention is not limited to the sequences disclosed but also includes such alternatives as contemplated by one of ordinary skill in the art. For example, the sequence can be pulling the trigger partially, depressing the latch member, and then pulling the trigger the rest of the way. The lighter in the low-force mode also may rely on the physical differences between intended and unintended users, for example, by controlling the spacing of the trigger and the latch, or adjusting the operation forces, or shape and size of the latch, trigger or lighter.

Another preferred aspect of the lighter 10 is that there is no element which blocks or prevents movement of the igniting assembly or the actuating assembly, such as, for example, the trigger 36, pivoting member 37 and linking rod 38, so that these components are always movable, and the lighter may be operational upon application of sufficient force on the trigger.

In order to make the lighter so that it is not excessively difficult for some intended users to actuate, the high-actuation force $F_{T1}$ preferably should not be greater than a predetermined value. It is contemplated that for the lighter of FIG. 2, the preferred value for $F_{T1}$ is less than about 10 kg and greater than about 5 kg. It is believed that such a range of force would not substantially negatively affect use by some intended users, and yet would provide the desired resistance to operation by unintended users. These values are exemplary and the operative force in the high-force mode can be more or less than the above ranges.

One of ordinary skill in the art can readily appreciate that various factors can increase or decrease the high-actuation force which an intended user can comfortably apply to the trigger. These factors may include, for example, the leverage to pull or actuate the trigger provided by the lighter design, the friction and spring coefficients of the lighter components, the trigger configuration, the complexity of the trigger actuation motion, the location, size and shape of the components, intended speed of activation, and the characteristics of the intended user. For example, the location and/or relationship between the trigger and the latch member and whether the intended user has large or small hands.

The design of the internal assemblies, such as the configuration of the actuating assembly, the configuration of the linking mechanism, the number of springs and forces generated by the springs all affect the force which a user applies to the trigger in order to operate the lighter. For example, the force requirements for a trigger which moves along a linear actuation path may not equal the force requirements to move a trigger along a non-linear actuation path. Actuation may require that a user move the trigger along multiple paths which may make actuation more difficult. While the embodiments disclosed have shown the preferred trigger with a linear actuation path, one of ordinary skill in the art can readily appreciate that non-linear actuation paths are contemplated by the present invention.

In the illustrated embodiment, the second trigger force $F_{T2}$ for the low-force mode is less than the first trigger force, preferably, but not necessarily, by at least about 2 kg. Preferably in the illustrated embodiment in FIG. 2C, the low-actuation force $F_{T2}$ is less than about 5 kg but greater than about 1 kg. These values are exemplary, as discussed above, and the present invention is not limited to these values as the particular desirable values will depend upon the numerous lighter design factors outlined above and the desired level of resistance to operation by unintended users.

Figure 3:
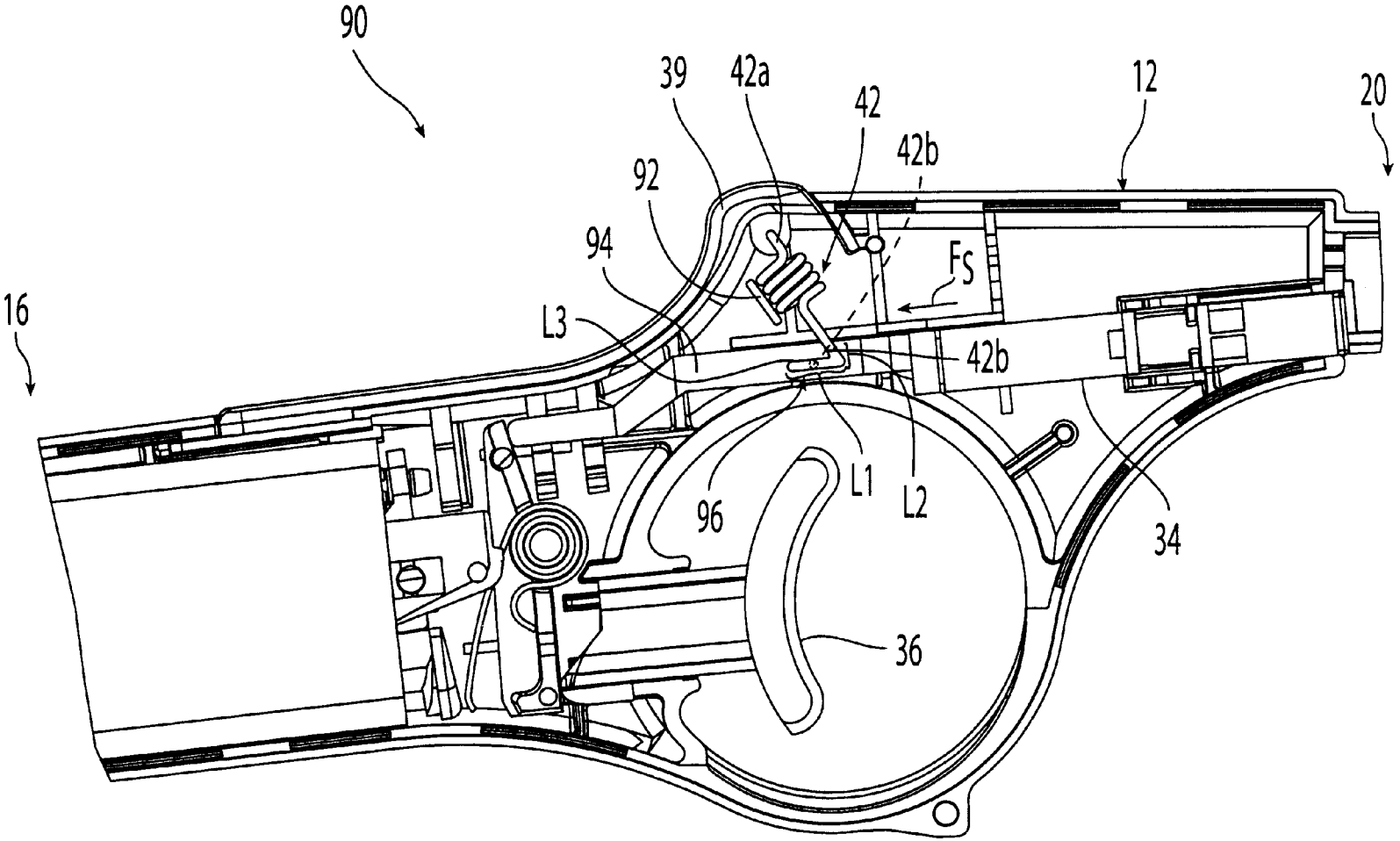
FIG. 3 is an enlarged, partial, side view of a second embodiment of the inventive lighter in the initial state, where the biasing member in the high-actuation-force position.

FIG. 3 shows an alternative embodiment lighter 90. Lighter 90 includes an actuating assembly as discussed above with respect to FIGS. 1–2, and is similar to the lighter 10 shown in FIGS. 1–2. Lighter 90 further may include guide wall 92, and a linking rod 94. The guide wall 92 is coupled to the housing 12 and supports and helps to locate the biasing member 42. Second linking rod 94 includes a generally L-shaped slot 96 adapted to movably receive leg 42*b* of spring 42. The slot 96 comprises a first portion L1 and a second portion L2 connected thereto. In lighter 90, the user moves leg 42*b* of biasing member 42 from the second portion L2 or high-force position to the first portion L1 or low-force position by depressing the latch member 39, as discussed above with respect to lighter 10.

In the high-force position or initial position, as shown in FIG. 3, the leg 42*b* of biasing member 42 is positioned in the second portion L2 of the slot 96 so that the biasing member 42 exerts spring force $F_S$ on the linking rod 94 when the user pulls the trigger 36. In the lighter shown in FIG. 3, spring 42 may be configured to apply a force biasing linking rod 94 toward the rear end 16 of the lighter in the at rest or initial position. In the low-force position or low-force mode, the end 42*b* (shown in phantom) of the biasing member 42 is repositioned so that it is aligned with and/or disposed in the first portion L1 of the slot 96. In this mode, no spring force is exerted on the linking rod 94 when the user pulls trigger 36 unless the end 42*b* of spring 42 abuts end L3 of the slot 96. If the leg 42*b* abuts the end L3 of the slot 96, further movement of trigger 36 toward end 16 will then be opposed by spring 42. In the high-force position, the user may have to apply a force to the trigger which will move the latch member 39 downward as discussed with respect to lighter 10.

In the low-force position, the second trigger force $F_{T2}$ is lower than the first trigger force $F_{T1}$ as discussed above because spring 42 only opposes motion of rod 94 when leg 42*b* abuts end L3. In the low force position, the user may have to overcome the friction forces generated by contact between the spring leg 42*b* and the surfaces of the linking rod 38 in the slot. Slot 96 can be configured so that the first and second portions L1 and L2 are longer or shorter and may be configured so that spring 42 travels in portion L1 without reaching end L3 so that spring 42 does not oppose motion of the trigger or linking rod 94 in the low-force mode to the same extent as in the high-force position.

Figure 4:
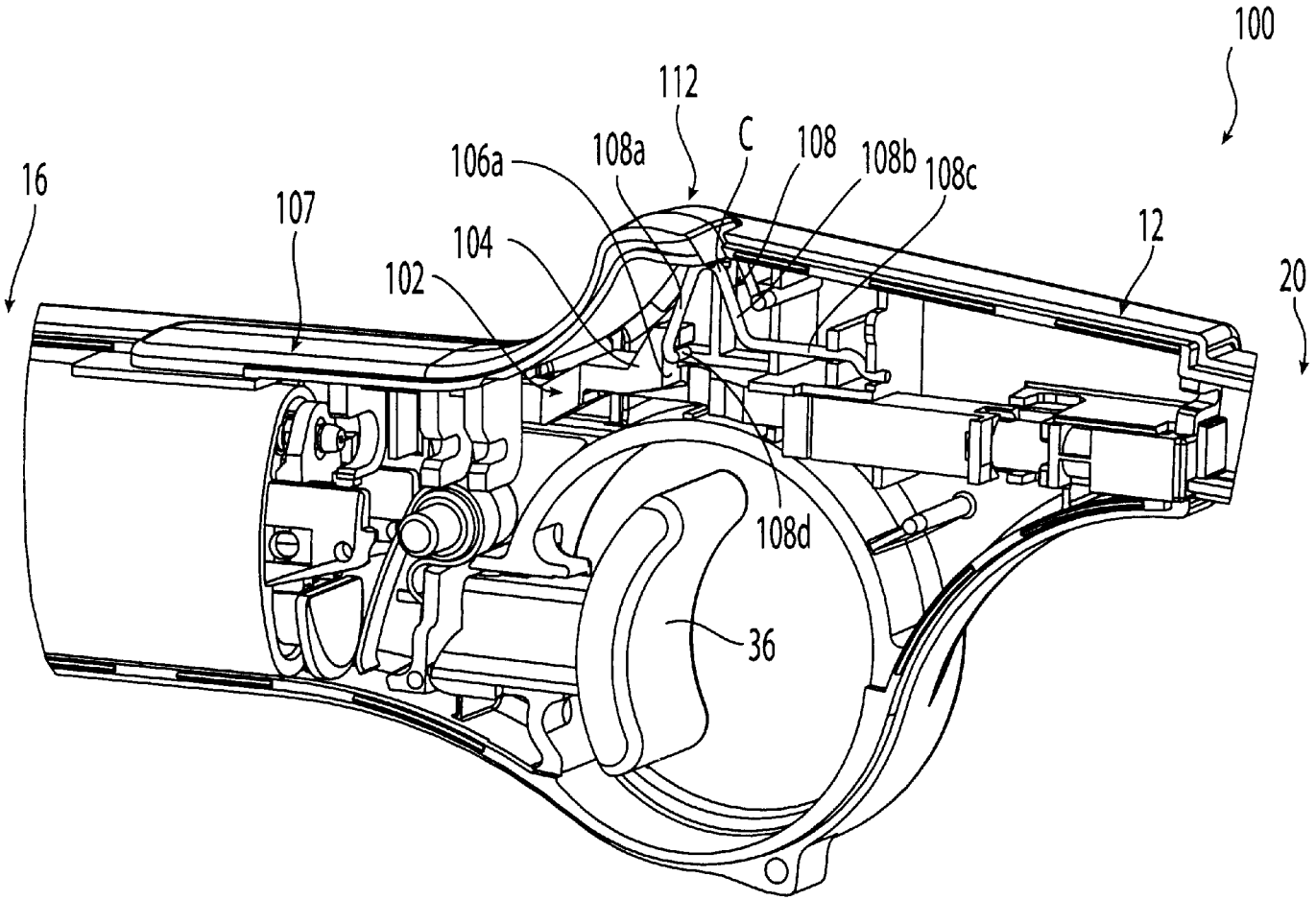
FIG. 4 is an enlarged, partial, perspective view showing a third embodiment of the lighter, wherein the lighter is in the initial state and the biasing member is in the high-actuation-force position.

FIG. 4 shows yet another alternative embodiment lighter 100. Lighter 100 includes an actuating assembly having a linking rod 102, as discussed above with respect to FIGS. 1–2, and is similar to the lighter 10. Linking rod 102 includes an integrally-formed, upwardly extending arm 104 which defines a cutout with vertical portion 106*a* and angled portion 106*b* at the free end thereof. The actuating assembly also includes a latch member 107 similar to latch member 39 as described with respect to the previously described embodiments.

A biasing member in the form of a spring 108 which includes a first leg 108*a*, a second leg 108*b* extending from the first leg 108*a*, and a third leg 108*c* extending from the second leg 108*b* is arranged in lighter 100. The first and second legs 108*a*, 108*b* are arranged in a substantially V-shape. Third leg 108*c* is substantially fixed to the housing 12, and in this embodiment, is substantially parallel with the linking rod 102. In an alternative embodiment third leg 108*c* may be shortened or effectively removed so that second leg 108*b* is directly connected to the housing 12.

In FIG. 4, spring 108 is operatively associated with latch member 107 and linking rod 102. More specifically, curve C of the spring 108, which is the apex between the first and second legs 108*a* and 108*b*, may contact boss 110 of the latch member free end 112. Spring 108 includes a bend to form leg 108*d*. In an initial or at rest state the leg 108*d* is in contact with vertical portion 106*a* defined in linking rod 102

Figure 4A:
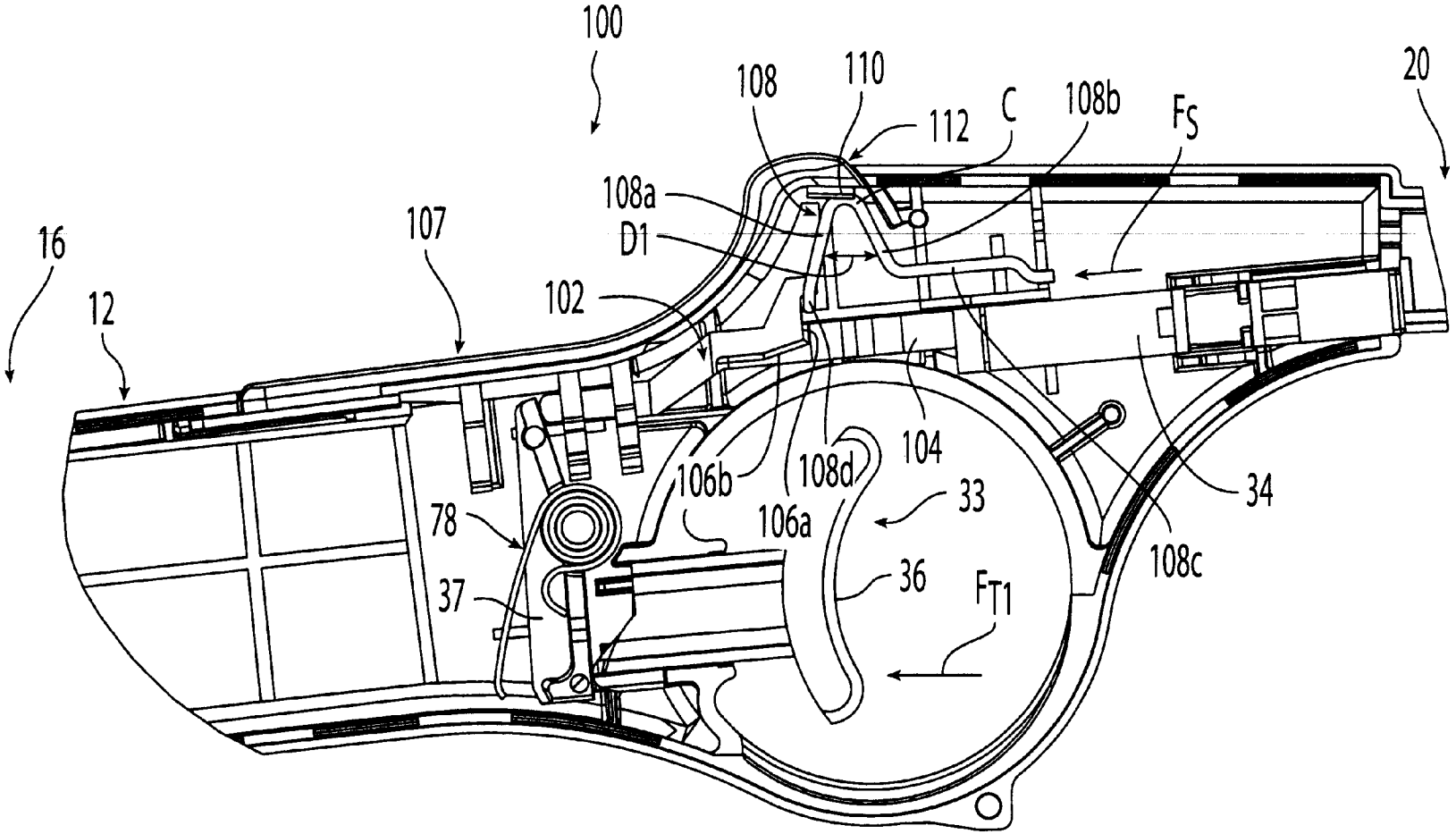
FIG. 4A is an enlarged, partial, side view of the lighter of FIG. 4.

(as best seen in FIG. 4A). Although in this embodiment leg 108*d* is shown contacting the linking rod 102 in the initial position, in an alternative embodiment leg 108*d* in the initial position may be spaced from the linking rod 102. While curve C has been illustrated and described to be in contact with the latch member 107 in the rest position, curve C alternatively can be positioned so that it does not contact the latch member in the at rest position.

Referring to FIG. 4, lighter 100 has different actuation movements or modes of operation so that one or the other can be used to operate the lighter. In the high-force position, the spring 108 contacts the linking rod 102 of the actuating assembly. When the user pulls the trigger 36, the spring 108 applies a spring force $F_S$ which opposes movement of the linking rod 102 toward front end 20. In order to operate the lighter, a user applies a first trigger force $F_{T1}$ to the trigger 36 greater than or equal to the sum of spring force $F_S$ and the additional opposing forces $F_{OP}$ described above.

Figure 4B:
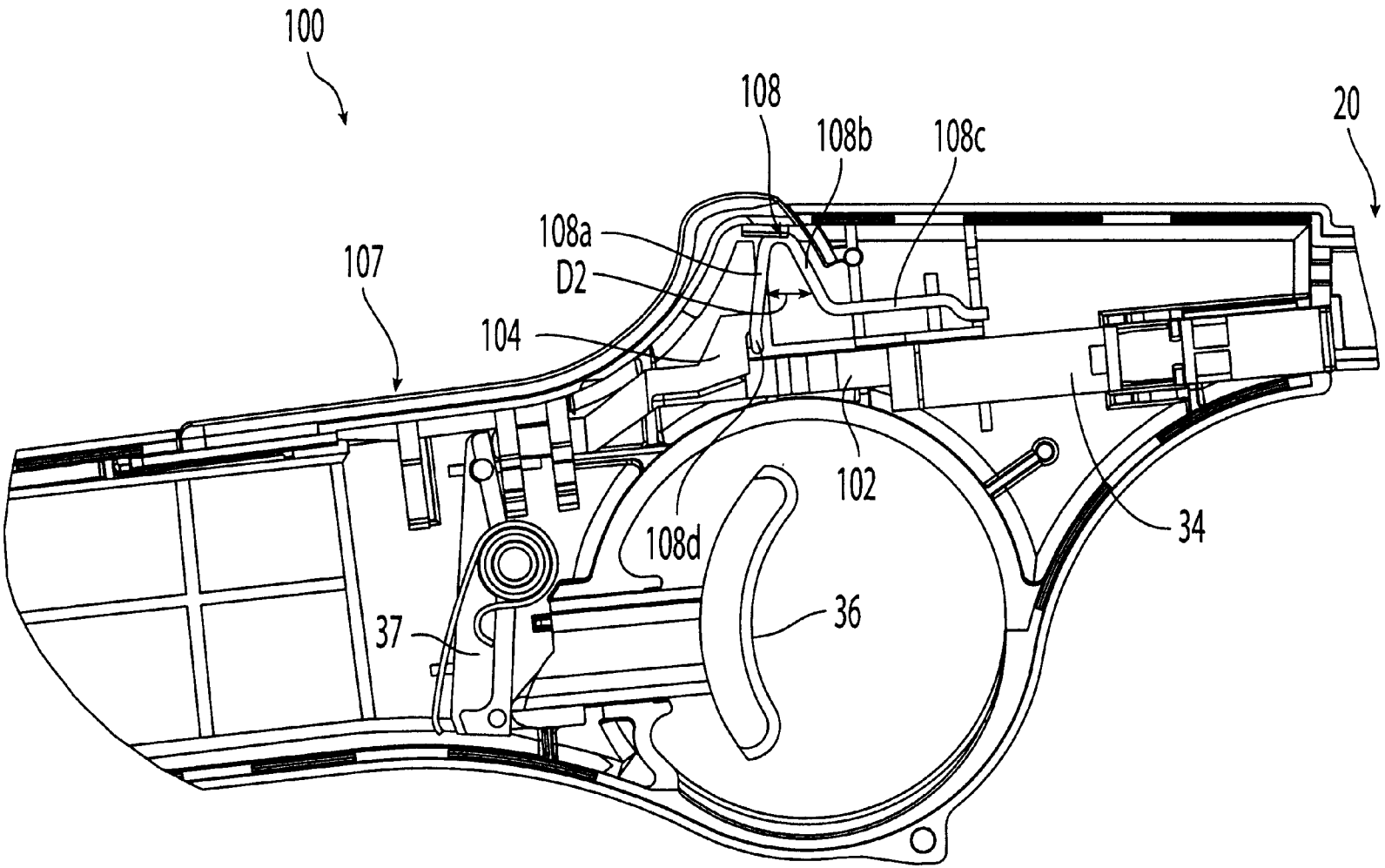
FIG. 4B is an enlarged, partial, side view of the lighter of FIG. 4A after the first actuating movement, where the biasing member is in the high-actuation-force position.

If the user applies sufficient first trigger force $F_{T1}$, linking rod 102 moves forward and compresses spring 108 so that the leg 108*a* moves toward leg 108*b*. This is illustrated by the difference in the initial distance D1 between the legs 108*a* and 108*b* (as shown in FIG. 4A) and in the post-actuation distance D2 (as shown in FIG. 4B). This change in distance also changes the spring's length. In an alternative embodiment, the spring 108 can be modified and cantilevered such that its length does not change when a sufficient trigger force is applied. The movement of the linking rod 102 also depresses and actuates the piezoelectric unit 34 and thus ignites the gas. If the force applied to the trigger is less than the first trigger force $F_{T1}$, the lighter will not operate in the high-actuation-force mode.

When the trigger 36 is released, the return spring within the piezoelectric mechanism 34 and the compressed spring 108 return to their initial positions thereby moving or assisting in moving the linking rod 102 into its initial position, and return the pivoting member 37 and the trigger 36 to their initial or at rest positions. Furthermore, spring 78, if present, may help to return components of the lighter to their original positions.

In the embodiment of FIG. 4, the spring 108 contacts the latch member 107, and latch member 107 remains in its initial position in the high-force mode. The spring 108 may not contact the latch member, and may or may not be connected to the latch member 107.

Figure 4C:
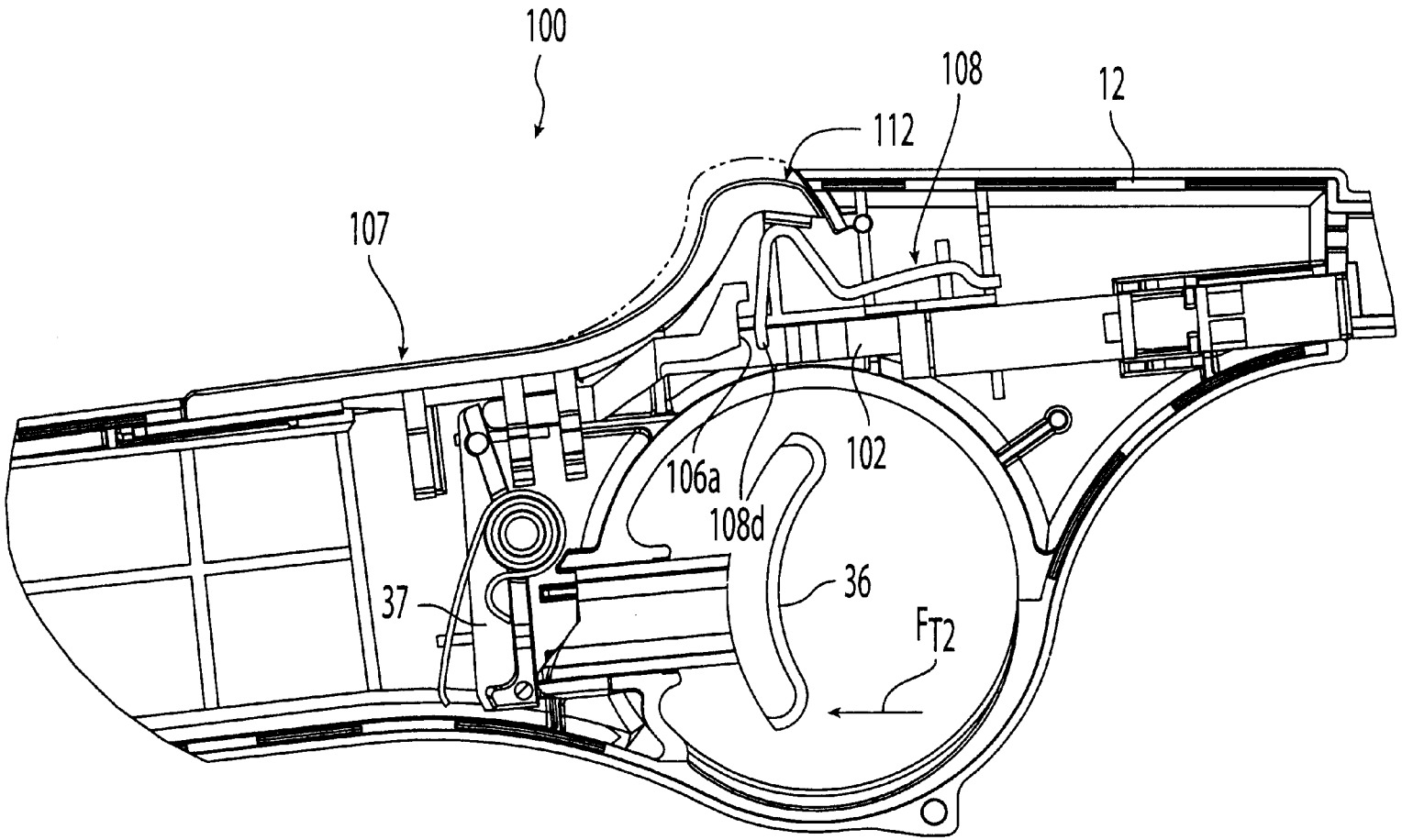
FIG. 4C is an enlarged, partial, side view of the lighter of FIG. 4A after the second actuating movement, where the biasing member is in the low-actuation-force position.

Alternatively, the lighter 100 may be operated in the low-force mode. Referring to FIG. 4C, this mode requires the user to move two components of the lighter for actuation as opposed to the high-force mode where the user only had to move one component of the lighter for actuation. This mode also requires the user to perform two different motions, one motion applied to the latch and a second motion applied to the trigger.

In the low-force mode, the free end 112 of the latch member 107 is moved downward toward the trigger 36 from its initial position (shown in phantom) to a depressed position, as shown in FIG. 4C. Due to the operative association between the latch member 107 and the spring 108, the latch member 107 moves the spring downward. The extent of the depression of latch member 107 determines the position of the leg 108*d* of the spring 108 with respect to the vertical portion 106*a*, angled or inclined surface portion 106*b*, and the lower surface of the linking rod 102 as discussed above with respect to lighter 10. The lighter is in the low-actuation force position, after leg 108*d* is moved out of contact with vertical portion 106*a* and a low-actuation force or second trigger force $FT_2$ may be exerted on the trigger 36 to actuate the lighter.

In this mode of operation, the second trigger force $FT_2$ is less, and optionally significantly less, than the high-actuation trigger force $F_{T1}$ used in the high-force mode, and preferably is substantially equal to the opposing forces $F_{OP}$ and any friction forces discussed above resulting from contact with the angled portion 106*b* and the lower surface of the linking rod. In this embodiment, similar to the lighter embodiments previously described, the spring 108 does not oppose operation of the lighter in the low-force mode to the same extent as in the high-force mode. The preferred values for the first and second trigger forces $F_{T1}$, $F_{T2}$ are the same values as discussed above with respect to lighter 10.

When the trigger 36 and latch member 107 are released, the return spring within the piezoelectric mechanism, moves or assists in moving the linking rod 102 into its initial position, the pivoting member 37 and the trigger 36 to their initial or at rest positions, and allows leg 108*d* to return into contact with vertical portion 106*a* of the cutout in linking rod 102. Also, when the trigger and latch member are released, the compressive force stored in legs 108*b* and 108*c*, biases the latch member 107 and assists the resiliency of the latch member in returning the latch member 107 to its initial, at rest, position. In this manner, the lighter returns to its at rest position where the spring 108 is in the high-force position unless the user depresses the latch member 107 again.

To operate the lighter in its low-force mode preferably requires a predetermined level of cognitive skills and physical abilities so that the latch member 107 may be depressed and the trigger actuated. Optionally, the level of dexterity and cognitive ability required to operate the lighter can be increased by requiring the latch member and trigger to be carried out in a proper sequence. As discussed above, the sequence can vary with the lighter configuration. In the lighter 100, as well as lighters 10 and 90 described above and lighter 114 described below, the trigger is always movable to operate the lighter.

FIG. 5 shows an alternative embodiment lighter 114. Lighter 114 includes a housing 12 with a latch member 116 pivotally attached to the housing 12 proximate to an actuating assembly which includes a trigger 118. Trigger 118 is slidably coupled to the housing 12, and is operatively connected to a piezoclectric unit 34 and valve actuator 30.

End 120 of the latch member 116 is a finger actuation portion, and in the initial position end 116 is biased to extend away from the lighter 114 by spring 121. The other end 122 of the latch member 116 defines a recess 124 (shown in phantom) for receiving a biasing member 126. The biasing member 126 in this embodiment is a coil spring but it can be any type of compression spring. In the initial position, the biasing member 126 shown in FIG. 5 is in a high-force position as discussed above with respect to the other embodiments, and is aligned with a portion of the trigger 118 and is compressed as the trigger 118 is pulled to increase the force required for actuation. The biasing member 126 may or may not be preloaded, when in the high-force position.

When a user completely depresses the finger actuation portion 120 of the latch member 116, the end 122 and biasing member 126 move downward out of alignment with the trigger 118, as shown in FIG. 5A. Thus, in FIG. 5A the biasing member 126 is in the low-force mode where a low-actuation-force substantially equal to or greater than $F_{T2}$ actuates the lighter 114, as discussed above with respect to the low-force mode of the other embodiments. It is contemplated that the preferred force values for the high-actuation force and the low-actuation force for lighter 114 may be different from those of lighters 10, 90 and 100 due to the different shape, size, force, and movement required to actuate the lighter. When the user releases the finger actuation portion 120 of the latch member 116, spring 121 returns the latch member 116 to its initial position where the lighter is in a high-force mode.

The biasing members or springs 42, 108, and 126 may be formed of a material such as metal, plastic, composite, etc. Preferably, these springs are formed of material which allows the spring to exert a force which remains substantially constant after multiple actuations of the lighter or is substantially non-degrading over the life of the lighter. Latch members 39 and 107 may be formed of a polymer which is resilient and flexible. One such polymer for example is polyacetal. However, other plastics with the necessary properties can be used. It is preferred that the forces required to operate the lighter in either mode remains substantially constant after multiple actuations and is substantially non-degrading during the expected life cycle of the lighter.

One feature of the lighters 10, 90, 100,114 is that in the high-force mode multiple actuating operations can be performed so long as the user provides the necessary actuation force. Another feature of the lighters 10, 90, 100, 114 is that in the low-force mode multiple actuating operations can be performed so long as the user depresses the latch member and provides the necessary actuation force. In particular, if the lighter does not operate on the first attempt, the user can re-attempt to produce a flame by actuating the trigger again while the latch member remains depressed.

While various descriptions of the present invention are described above, it should be understood that the various features of each embodiment can be used singly or in any combination thereof. Therefore, this invention is not to be limited to only the specifically preferred embodiments depicted herein. Further, it should be understood that variations and modifications within the spirit and scope of the invention may occur to those skilled in the art to which the invention pertains. For example, insulated wire 54 (shown in FIG. 1) may be replaced by a helical coil spring concentrically disposed either inside or outside of conduit 24. This modification may require additional modifications, as known by those of ordinary skill in the art, to complete the electrical communication between the piezoelectric unit and the nozzle.

Figure 6:
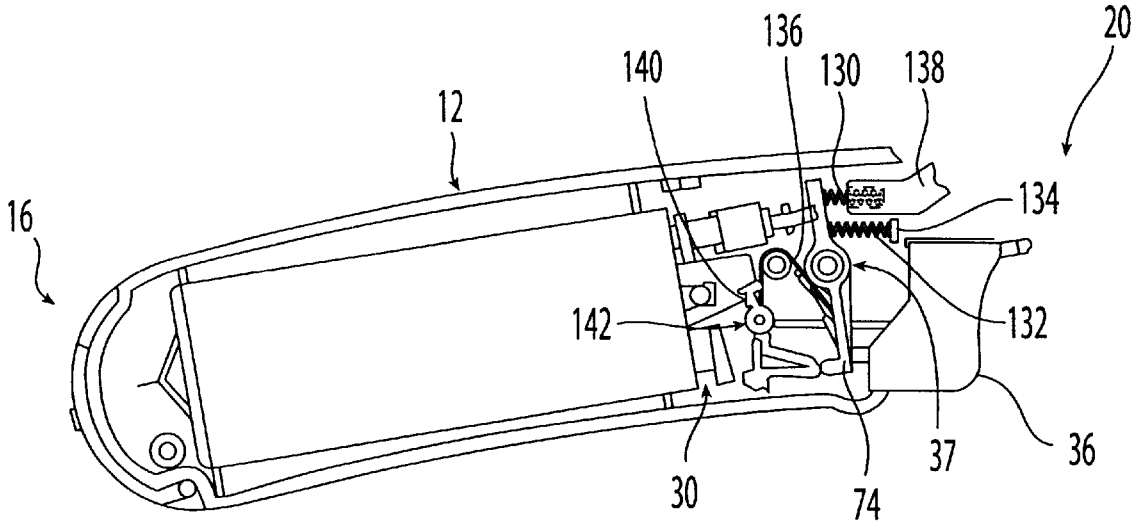
FIG. 6 is a partial, cut-away, side view of another embodiment of the lighter of the present invention showing various modifications.

In another modification, the linking member can have a leaf spring extending from the trigger toward the valve actuator, or a compression spring extending between the trigger and the valve actuator. As another example, the lighters 10, 90, 100, and 114 can include, as shown in FIG. 6, spring 130 extending between linking rod 138 and pivoting member 37, spring 132 extending between housing portion 134 and pivoting member 37, and spring 136 mounted to housing pin 140 and extending arm 74 of pivoting member 37 and extension 140 of pivoting linking member 142. Springs 130, 132 and 134 can be used alone or in combination. In addition, the movable biasing member in each of the embodiments described above may include more than one spring, and may include one or more springs having different spring forces, which may be arranged in coaxial fashion such as coaxial coil springs.

Furthermore, although in the presently discussed embodiments the low-force mode relies on the user operating two components, in an alternative embodiment, the low-force mode can rely on the user operating a number of components. In addition, although the actuating assembly in some of the embodiments is shown to include a trigger, pivoting member and linking rod, the actuating assembly can be varied, such as, for example, to include only a trigger as shown in the embodiment of FIGS. 5 and 5A.

Alternatively, the latch member may be separate from or integral with the biasing member. In addition, the movable biasing member described in the various embodiments may be located in different positions. For example, the movable biasing member may be located between the trigger and the valve actuator in a high-force position. As another example, the biasing member can be located so that a finger actuation portion of the biasing member is outside of the housing and the remainder of the biasing member is within the housing. Thus, the biasing member can be moved from the high actuation force position to the low actuation force position by a user contacting the finger actuation portion.

Accordingly, all expedient modifications readily attainable by one versed in the art from the disclosure set forth herein which are within the scope and spirit of the present invention are to be included as further embodiments of the present invention. Moreover, the features of the embodiments can be combined with additional cognitive effects such as a more complex trigger actuation path to make actuation of the lighter more difficult. The scope of the present invention is accordingly defined as set forth in the appended claims.

We claim:

1. A lighter comprising:

a housing having a supply of fuel;

an actuating member for selectively igniting the fuel, the actuating member associated with the housing; and a biasing member moveable by a user between a first biasing member position and a second biasing member position, wherein the user applies a first actuating force to the actuating member to ignite the fuel when the biasing member is positioned in the first biasing member position and a second actuating force to the actuating member to ignite the fuel when the biasing member is positioned in the second biasing member position, the first actuating force being greater than the second actuating force.

2. The lighter according to claim 1, wherein the first actuating force is substantially greater than the second actuating force.

3. The lighter according to claim 1, wherein the second actuating force is less than about 5 kg, but greater than about 1 kg.

4. The lighter according to claim 1, wherein the actuating member is a trigger movably coupled to the housing.

5. The lighter according to claim 1, wherein the actuating member is part of an actuating assembly.

6. The lighter according to claim 5, wherein the actuating assembly comprises a trigger and the actuating member is a linking rod.

7. The lighter according to claim 1, wherein actuating the lighter can be accomplished by two different actuation movements.

8. The lighter according to claim 1, further including an ignitor assembly for igniting the fuel.

9. The lighter according to claim 8, wherein the ignitor assembly comprises a piezoelectric unit.

10. The lighter according to claim 8, wherein the actuating member selectively dispenses the fuel and activates the ignitor assembly.

11. The lighter according to claim 1, further comprising a latch member coupled to the housing and operatively associated with the biasing member.

12. The lighter according to claim 11, wherein the latch member further includes first and second ends, the second end movable from an initial position where the biasing member is in the first biasing member position to a final position where the biasing member is in the second biasing member position.

13. The lighter according to claim 1, wherein when the biasing member is in the second biasing member position the biasing member is in contact with the actuating member.

14. The lighter according to claim 1, wherein the biasing member is operatively associated with the actuating member when the biasing member is in the second biasing member position.

15. The lighter according to claim 1, wherein the biasing member is disengaged from the actuating member when the biasing member is in the second biasing member position.

16. The lighter according to claim 1, wherein the biasing member is selected from the group consisting of a coil spring, a leaf spring, torsion spring, a substantially V-shaped spring, and a metal spring.

17. The lighter of claim 1, wherein the biasing member is a V-shaped spring comprising a first leg and a second leg extending from the first leg, the second leg fixedly coupled to the housing, wherein in the first biasing member position the first leg of the spring contacts the actuating member.

18. The lighter of claim 17, wherein when the biasing member is in the first biasing member position and the lighter is actuated, the first leg moves with respect to the second leg.

19. The lighter according to claim 1, wherein after multiple actuations of the lighter the first actuating force remains substantially constant.

20. The lighter according to claim 1, wherein the lighter is configured and adapted to operate, when the biasing member is arranged in the first biasing member position, upon application of less than about 10 kg to the actuating member.

21. The lighter according to claim 20, wherein the lighter is configured and adapted to operate, when the biasing member is arranged in the first biasing member position, upon application of between about 5 kg and about 10 kg to the actuating member.

22. The lighter according to claim 1, wherein the lighter is configured and adapted to operate, when the biasing member is arranged in the second biasing member position, upon application of less than about 5 kg to the actuating member.

23. The lighter according to claim 1, wherein the lighter is configured and adapted to operate, when the biasing member is arranged in the first biasing member position, by a single finger of a user.

24. The lighter according to claim 21, wherein the lighter is configured and adapted to operate, when the biasing member is arranged in the second biasing member position, by a first and second finger of the user.

25. The lighter according to claim 1, wherein the actuating member is not blocked from movement.

26. The lighter according to claim 1, wherein the lighter is configured and adapted to operate, when the biasing member is arranged in the first biasing member position, by a user only applying force to the actuating member.

27. The lighter according to claim 11, wherein the lighter is configured and adapted to operate, when the biasing member is arranged in the second biasing member position, by movement of the latch member and the actuating member.

28. The lighter according to claim 27, wherein the latch member moves by elastically bending.

29. The lighter according to claim 27, wherein the lighter is configured and adapted to operate when the biasing member is arranged in the second biasing member position by moving the latch member before moving the actuating member.

30. The lighter according to claim 1, wherein the lighter is configured and adapted to operate by relying on the physical characteristics of a user when in the first biasing member position, and relying more on the cognitive abilities and dexterity of the user when in the second biasing member position.

31. The lighter according to claim 1, wherein the biasing member has an initial length which changes elastically when the lighter is actuated with the biasing member in the first biasing member position.

32. The lighter according to claim 1, wherein the lighter is a utility lighter.

33. The lighter according to claim 1, wherein the actuating member has an inclined surface and the biasing member is in contact with the inclined surface when in the second biasing member position.

34. A lighter comprising:

a housing having a supply of fuel;

an actuating member for selectively releasing the fuel;

an ignitor assembly for igniting the released fuel;

a latch member coupled to the housing to permit movement between a first latch position and a second latch position; and a biasing member operatively associated with the latch member, wherein at least a portion of the biasing member is repositioned by the latch member from a first biasing member position which resists movement of the actuating member to a second different biasing member position which does not resist movement of the actuating member to the same extent as in the first biasing member position;

further wherein the actuating member is movable to ignite the released fuel when the biasing member is in the first biasing member position and when the biasing member is in the second biasing member position.

35. A lighter comprising:

a housing having a supply of fuel;

an ignitor assembly for igniting the released fuel;

an actuating assembly for moving the valve to release the fuel that includes at least one trigger; and a biasing member at least a portion of which is moveable by a user between a first, at rest state where an engaging portion of the biasing member is associated with an engaging portion of the actuating assembly and provides a force to resist movement of the trigger, and a second state where the biasing member does not significantly resist movement of the trigger, wherein the lighter is configured and adapted so that when the biasing member is in the first state, less than about 10 kg applied to the trigger activates the ignitor assembly.

36. The lighter according to claim 35, further including a valve assembly for dispensing the fuel having a valve movable between a first valve position and a second valve position, and upon applying the less than about 10 kg to the trigger the valve moves from the first valve position to the second valve position.

37. The lighter according to claim 35, wherein in the second state the biasing member does not significantly resist the movement of the actuating assembly for a portion of the movement of the actuating assembly.

38. The lighter according to claim 35, wherein the engaging portion of the actuating assembly is on the trigger.

39. The lighter according to claim 35, wherein the actuating assembly further includes a linking rod operatively associated with the ignitor assembly, and a pivoting member connected to the housing and disposed between the trigger and the linking rod; and the linking rod includes the engaging portion of the actuating assembly.

40. The lighter according to claim 39, further including a latch member coupled to the housing; and the biasing member is operatively associated with the latch member.

41. The lighter according to claim 35, wherein in the second biasing member position when a second trigger force less than the first trigger force is applied to the actuating assembly the valve moves from the first valve position to the second valve position.

42. A lighter comprising:

a housing having a supply of fuel;

an actuating member movable to selectively dispense the fuel;

an ignitor assembly for igniting the dispensed fuel; and a biasing member disposed within the housing and moveable from a first biasing position which engages the actuating member at a first location to a second biasing position which engages the actuating member at a second location, the biasing member having an initial length, wherein the biasing member is configured and adapted so that when the actuating member is moved when the biasing member is engaged with the actuating member, the length of the biasing member changes between a first length and a second different length;

further wherein the actuating member is movable to dispense the fuel when the biasing member is in the first biasing position and when the biasing member is in the second biasing position.

43. The lighter of claim 42, wherein in the second biasing member position the biasing member does not resist movement of the actuating member.

44. The lighter of claim 42, wherein the first length is less than the second length.

45. The lighter of claim 42, wherein in the second biasing member position, the biasing member contacts the actuating member at an inclined surface.

46. A lighter comprising:.

a housing having a supply of fuel;

an ignitor assembly for igniting the dispensed fuel;

an actuating member associated with the housing, wherein a predetermined actuating force is necessary to move the actuating member to an actuation position to actuate the lighter; and a biasing member associated with the housing, and repositionable by a user to a first position wherein the biasing member is associated with the actuating member such that a first actuating force greater than said predetermined actuating force is required to move the actuating member to the actuation position;

wherein the actuating member is movable to actuate the lighter independent of the position of the biasing member.

47. The lighter according to claim 46, wherein the biasing member is movable to a second position such that the user applies a second actuating force to move the actuating member to the actuation position, wherein the second actuating force is less than the first actuating force.

48. The lighter according to claim 47, wherein the second actuating force is substantially the same as the predetermined actuating force.

49. The lighter according to claim 46, wherein the actuating member is a trigger.

50. The lighter according to claim 46, wherein the actuating member is part of an actuating assembly.

51. The lighter according to claim 50, wherein the actuating assembly comprises a trigger and the actuating member is a linking rod.

52. The lighter of claim 35, wherein the trigger is selectively operable in a high-force mode and a low-force mode.

* * * * *